US006851405B2

(12) United States Patent
Kajino et al.

(10) Patent No.: US 6,851,405 B2
(45) Date of Patent: Feb. 8, 2005

(54) MOTOR-DRIVEN STARTER HAVING PINION TO ENGAGE RING GEAR OF INTERNAL COMBUSTION ENGINE

(75) Inventors: Sadayoshi Kajino, Nagoya (JP); Youichi Hasegawa, Kasugai (JP); Kazuaki Murase, Konan (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/833,061

(22) Filed: Apr. 28, 2004

(65) Prior Publication Data

US 2004/0250784 A1 Dec. 16, 2004

(30) Foreign Application Priority Data

Jun. 10, 2003 (JP) ..... 2003-165201

(51) Int. Cl.[7] ..... F02N 11/00; F02N 15/06

(52) U.S. Cl. ..... 123/179.25; 74/7 A; 290/38 R

(58) Field of Search ..... 74/7 A; 290/38 R; 123/179.29, 179.25, 179.3, 179.1

(56) References Cited

U.S. PATENT DOCUMENTS 5,621,249 A * 4/1997 Shiga et al. ..... 290/38 R
5,765,439 A * 6/1998 Araki ..... 74/7 R
5,945,742 A * 8/1999 Araki et al. ..... 290/38 R
2003/0230271 A1 * 12/2003 Maruhashi et al. ..... 123/179.3
2004/0108727 A1 * 6/2004 Kurasawa et al. ..... 290/38 R
2004/0177710 A1 * 9/2004 Kajino et al. ..... 74/7 A

FOREIGN PATENT DOCUMENTS

JP Y2 55-45900 10/1980

OTHER PUBLICATIONS

U.S. Appl. No. 10/795,283, filed Mar. 9, 2004, Hasegawa et al.

* cited by examiner

*Primary Examiner*—Henry C. Yuen
*Assistant Examiner*—Arnold Castro
(74) *Attorney, Agent, or Firm*—Oliff & Berridge, PLC

(57) ABSTRACT

A starter includes a motor, an output shaft, a first spline connection member disposed between the motor and the output shaft, a pinion to be engaged with a ring gear of an engine, a second spline connection member disposed between the output shaft and the pinion, a pinion spring to apply its spring force to the pinion toward the ring gear, a lever, an electromagnetic switch to drive the output shaft toward the ring gear when the electromagnetic switch is excited and to operate the motor when the lever moves to a prescribed position, a drive spring to apply its spring force to the pinion when the electromagnetic switch drives the output shaft toward the ring gear. The first and second spline connection members rotate the pinion relative to the output shaft an angle more than a half of a pitch of the pinion when the helical connection member is driven by the electromagnetic switch toward the ring gear.

11 Claims, 6 Drawing Sheets

MOTOR-DRIVEN STARTER HAVING PINION TO ENGAGE RING GEAR OF INTERNAL COMBUSTION ENGINE

CROSS REFERENCE TO RELATED APPLICATION

The present application is based on and claims priority from Japanese Patent Application 2003-165201 filed Jun. 10, 2003, the contents of which are incorporated herein by reference.

BACKGROUND OF THE INVENTION

1. Field of the Invention

The present invention relates to a motor-driven engine starter that has a pinion to be engaged with a ring gear of an engine.

2. Description of the Related Art

JP-Y2-55-45900 discloses a starter that has a starting motor, an output shaft, a spline tube, a pinion and an electromagnetic switch that has a drive spring. The output shaft and the spline tube are connected by a helical spline connection so that the electromagnetic switch pushes the pinion via a lever to engage a ring gear of an engine when the electromagnetic switch operates.

However, there is a considerable probability, such as 40%–60%, that the pinion cannot completely engage the ring gear in such a starter. In order to provide the complete engagement of the pinion with the ring gear, the starting motor forcibly rotates the pinion under the spring force of the drive spring. In that case, the pinion and the ring gear are subject to a considerable shock and may wear or crack.

Although the pinion is rotated a little by the helical spline connection under a combined spring force of the pinion spring and the drive springs before the starting motor operates, the pinion spring and the drive spring are not arranged to allow the pinion to rotate a suitable angle to increase the probability of the complete engagement. In other words, the pinion spring is not compressed to provide a suitable stroke for the pinion to rotate about the output shaft by such a suitable angle.

SUMMARY OF THE INVENTION

The present invention has been made in view of the above problem and has an object to solve the above-described problem.

According to a feature of the invention, an engine starter includes an electric motor, a main switch connected between the electric motor and a power source, an output shaft, a first spline connection member disposed between the electric motor and the output shaft, a pinion disposed at an end of the output shaft to be engaged with or disengaged from a ring gear of an engine, a second spline connection member disposed between the output shaft and the pinion, a pinion spring disposed between the output shaft and the pinion to apply its spring force to the pinion toward the ring gear, a lever connected to the output shaft, an electromagnetic switch connected to the lever to drive the output shaft toward the ring gear when it is excited and to turn on the main switch when the lever moves to a prescribed position, a drive spring disposed between the output shaft and the electromagnetic switch to apply its spring force to the pinion when the electromagnetic switch drives the output shaft toward the ring gear. At least one of the first and second spline connection members includes a spline connection member that rotates the pinion relative to the output shaft a prescribed angle that is equal to or more than a half of the prescribed pitch when the helical connection member is driven by the electromagnetic switch toward the ring gear. For this purpose, the spring constant of the pinion spring is arranged to be lower than the drive spring so that the pinion spring can be compressed before the drive spring is compressed to provide a stroke that allows the pinion to rotate the prescribed angle about the output shaft before the main switch is closed.

Therefore, the pinion can engage the ring gear before it is driven by the motor at a high probability, such as 98%. This effectively decreases the impacting shock applied to the ring gear and the pinion.

In the above engine starter, it is preferable that the first spline connection member includes a helical spline connection member; and the second spline connection member comprises a straight spline connection member. In the above engine starter, the first spline connection member may include a spline tube that supports the output shaft.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

FIG. 1 is a fragmentary cross-sectional longitudinal view of a starter according to a preferred embodiment of the invention, where the output shaft shown above line A—A represents a stationary state thereof and the output shaft below line A—A represents an engagement state in which a pinion is in engagement with a ring gear of an engine, and where a plunger shown above line B—B represents a stationary state when a main switch of the starter is turned off, and the plunger shown below line B—B represents an operational state when the main switch is turned on.

DETAILED DESCRIPTION OF THE PREFERRED EMBODIMENTS

A starter according to a preferred embodiment of the invention will be described with reference to the appended drawings.

Figure 1:
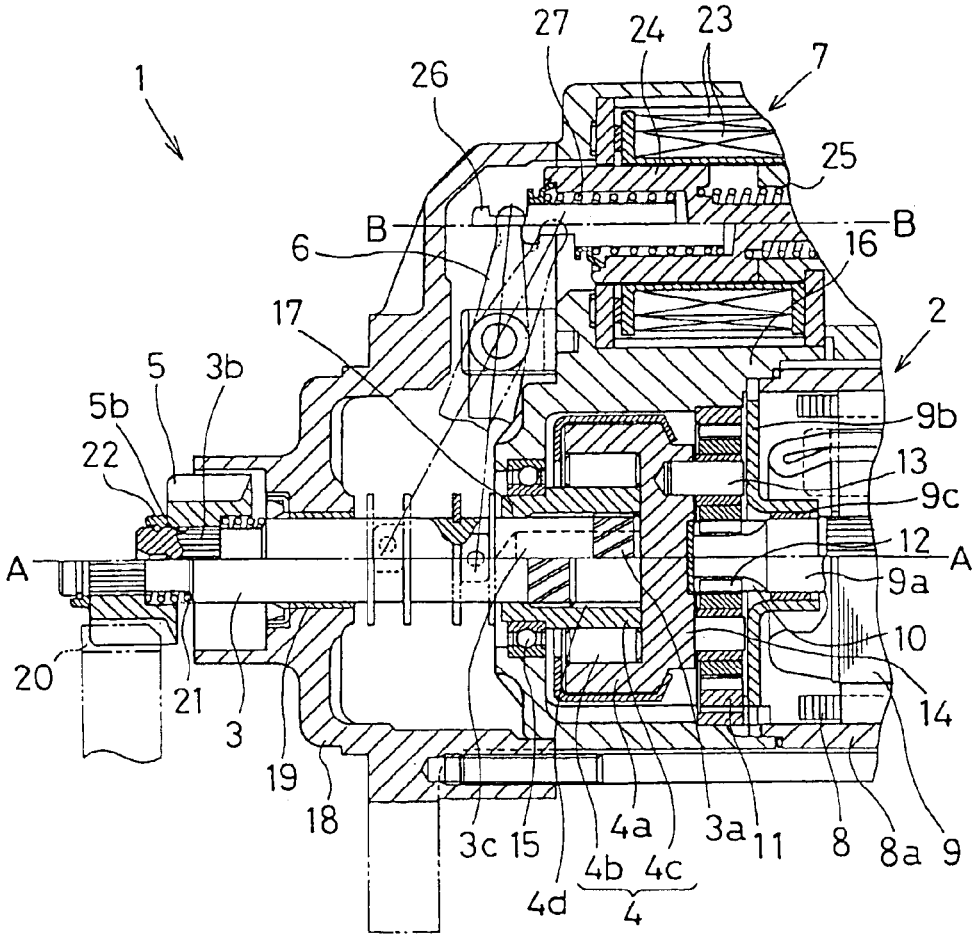
Figure 2A:
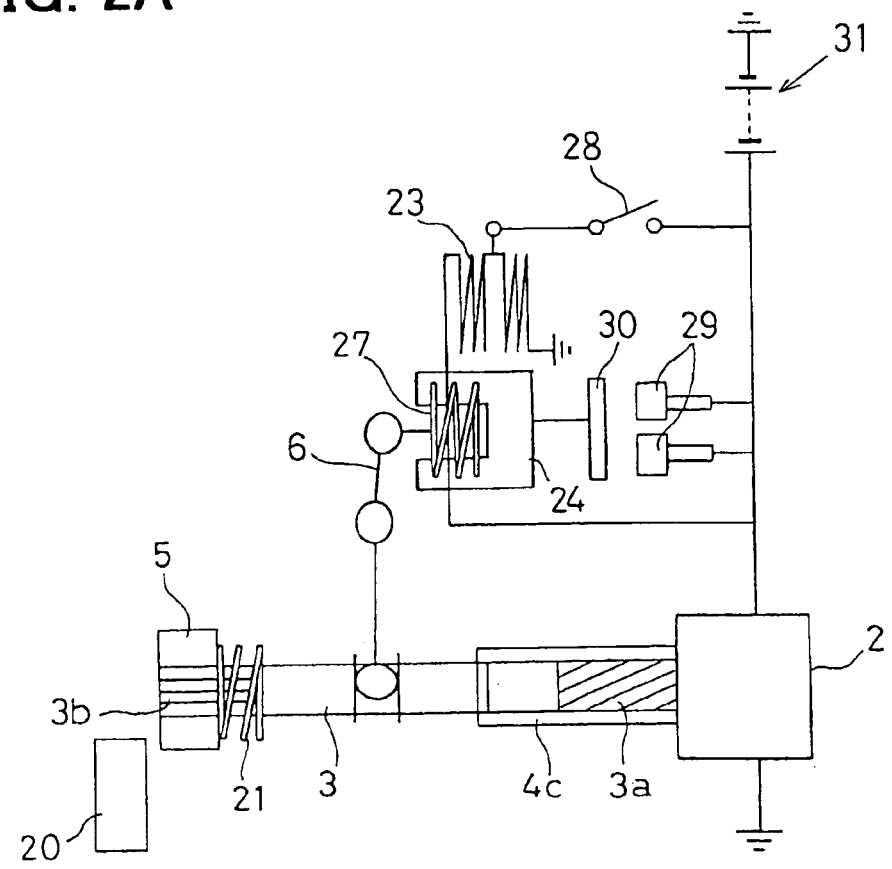
FIG. 2A is a schematic diagram illustrating operation of the starter according to the preferred embodiment.
Figure 2B:
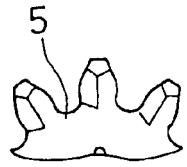
FIG. 2B is a fragmentary plan view of a pinion of the starter.

As shown in FIG. 1, the starter 1 is constituted of a dc motor 2, an output shaft 3, a one-way clutch 4 that is connected to a speed reduction mechanism, a pinion 5 that is supported by an end of the output shaft 3, a shift lever 6, an electromagnetic switch 7, a center casing 16, a housing 18 etc. The speed reduction mechanism is housed in the center casing 16 and connected to the motor 2 to reduce the rotation speed of the motor at a prescribed ratio. The one-way clutch 4 is also housed in the center casing 16 to connect the output shaft 3 and the speed reduction mechanism in one rotation direction. The electromagnetic switch 7 drives a main switch of the motor and pushes the pinion 5 via the shift lever 6 to engage a ring gear 20 of an engine.

When the main switch is turned on by the electromagnetic switch 7, the dc motor 2 is supplied with dc power from a vehicle battery 31 so that a motor shaft 9*a* of the motor 2 can rotate.

The speed reduction mechanism includes a sun gear 10 formed on the surface of the front end of the motor shaft 9*a*, a ring-shaped internal gear 11 that coaxially surrounds the sun gear 10, a plurality of planetary gears 12 disposed between the sun gear 10 and the internal gear 11, gear shafts 13 and a carrier 14. The sun gear 10, the internal gear 11 and the planetary gears engage each other so that the revolution of the planetary gears 12 can be transmitted to the carrier 14 via the gear shafts 13. The front end of the motor shaft 9*a* is supported by a partition member 9*b* via a bearing 9*c*.

The one-way clutch 4 is a roller-type clutch that includes a clutch outer member 4*a*, a plurality of rollers 4*b* and a clutch inner member 4*c*, which will be sometimes referred to as a spline tube below.

The clutch outer member 4*a* is integrated with the carrier 14 and has a cylindrical inner surface at which a plurality of cam chambers (not shown) is formed.

The rollers 4*b* are respectively disposed in the cam chambers so that the rollers 4*b* can be clutched between the cam chambers and the peripheral surface of the clutch inner member 4*c* when the clutch outer member 4*a* is rotated by the speed reduction mechanism in one direction. Thus, torque of the dc motor can be transmitted from the clutch outer member 4*a* to the clutch inner member 4*c*.

The clutch inner member 4*c* has a cylindrical outer surface, which is supported by the center casing 16 via a bearing 15 at an end thereof opposite the motor 2. The clutch inner member 4*c* also has a cylindrical inner surface, on which female helical splines 4*d* are formed. A stopper 17 is also formed on the inner surface of the clutch inner member 4*c*, where the bearing 15 is disposed on the outer surface thereof.

Because the clutch outer member 4*a* and the carrier of the speed reduction mechanism is integrated, the bearing 9*b* supports the rear end of the clutch inner member 4*c* as well as the speed reduction mechanism. Therefore, the total axial length of the one-way clutch and the speed reduction mechanism can be significantly reduced.

The motor 2 has the motor shaft 9*a*, a yoke 8*a*, and the center casing 16 is disposed between the yoke 8*a* and the housing 18. The housing 18 supports the output shaft 3 a bearing 19.

The output shaft 3 has a rear end that has male helical splines 3*a* and a front end that has a plurality of straight male splines 3*b* on the outer surface thereof. The rear end of the output shaft 3 is inserted into the inside of the clutch inner member 4*c* to engage the male helical splines 3*a* with the female helical splines 4*d* of the clutch inner member 4*c*. The output shaft 3 has a longitudinal hollow 3*c* at the axial center of the rear end thereof to hold lubricating oil and to reduce weight.

The pinion 5 has an inner surface on which a plurality of female straight splines 5*b* is formed to engage the male splines 3*b* of the output shaft 3. A pinion spring 21 is inserted in the inside of the pinion 5 to bias the pinion 5 toward the ring gear 20. A collar 22 is fixed to the outer surface of the output shaft 3 at the front end thereof to restrict the pinion 5 to thrust forward excessively. The pinion 5 is also restricted by the pinion spring 21 to move backward when it is retracted and the pinion spring 21 is fully compressed.

The length and other shapes and dimensions of the male and female helical splines 3*a*, 4*d* and the male and female straight splines 3*b*, 5*b* are designed so that the pinion 5 can rotate more than an angle that corresponds to a half of the tooth pitch of the gears of the pinion 5 from a position of the pinion 5 in contact with the ring gear without gear engagement when the output shaft 3 moves before the main switch of the motor 2 is turned on.

The electromagnetic switch 7 includes a solenoid 23 that is excited when a start switch 28 is turned on a plunger 24 that is driven by the excited solenoid 23 to the right, a return spring 25 that retracts the plunger 24 to the left when the solenoid 23 becomes unexcited and a hook member 26 that is inserted into the plunger 24 to connect the shift lever 6 and the plunger 24. A drive spring 27 is disposed between the plunger 24 and the hook member 26. The spring constant and the initial load of the pinion spring 21 and the drive spring 27 is designed so that the pinion spring 21 can be compressed before the drive spring 27 when the pinion 5 bumps the ring gear 20 without engagement therewith, and further movement is stopped. In this embodiment, the spring constant and the initial load of the drive spring 27 is larger than the pinion spring 21.

As shown in FIGS. 2A–5, the main switch of the motor 2 is constituted of a pair of stationary contacts 29 and a movable contact 30. The electromagnetic switch 7 includes a pressure spring (not shown) that biases the movable contact 30 against the stationary contacts 29 at a prescribed contact pressure when the main switch is turned on.

When the starting switch 28 turned on to excite the solenoid 23 of the electromagnetic switch 7 the starter 1, the plunger 24 is pulled to the right to drive the output shaft 3 forward (or to the left) via the shift lever 6. Accordingly, the output shaft 3 is rotated by the helical spline connection of the male helical spline 3*a* thereof with the female helical spline 4*d* of the clutch inner member 4*c*. Thus, the pinion 5 continues to move until the pinion 5 engages the ring gear 20 or is stopped by a portion of the ring gear 20 before complete engagement.

Figure 5:
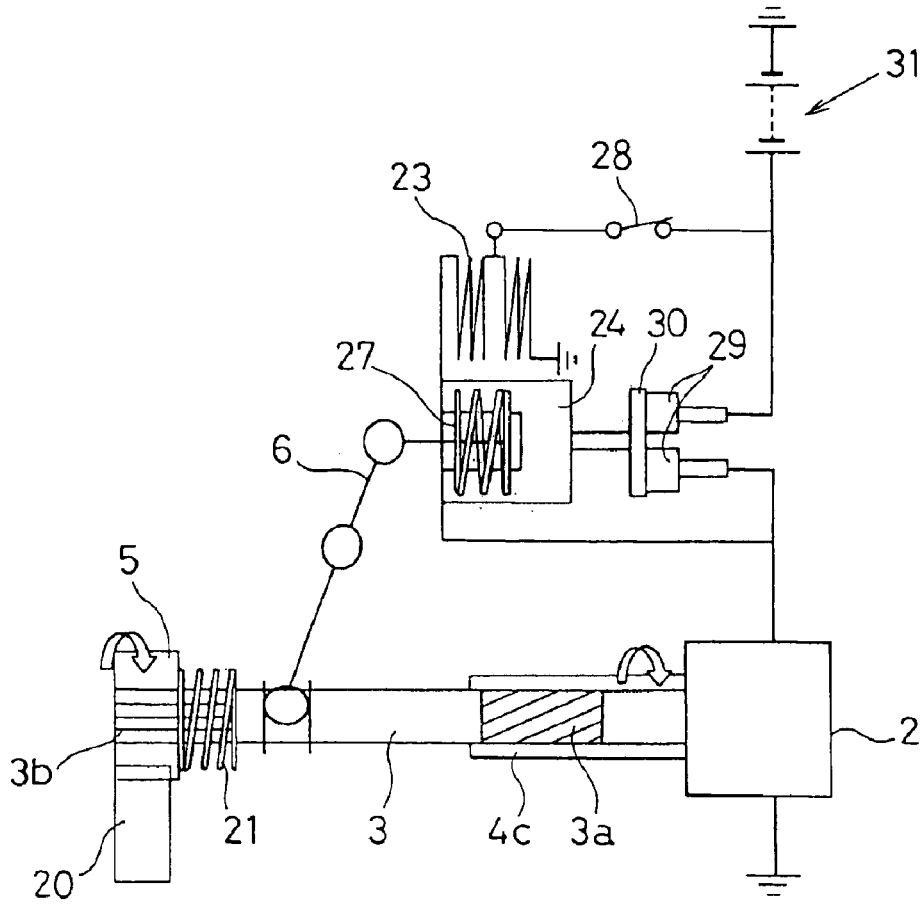
FIG. 5 is a schematic diagram illustrating operation of the starter according to the preferred embodiment.

If the pinion 5 fully engages the ring gear 20 as shown in FIG. 5, the main switch 29, 30 of the motor 2 is turned on under a spring force exerted by a pressure spring (not shown) that is included in the electromagnetic switch 7. As a result, the armature 9 rotates the output shaft 3 via the speed reduction mechanism to crank the engine via the ring gear 20.

Figure 3A:
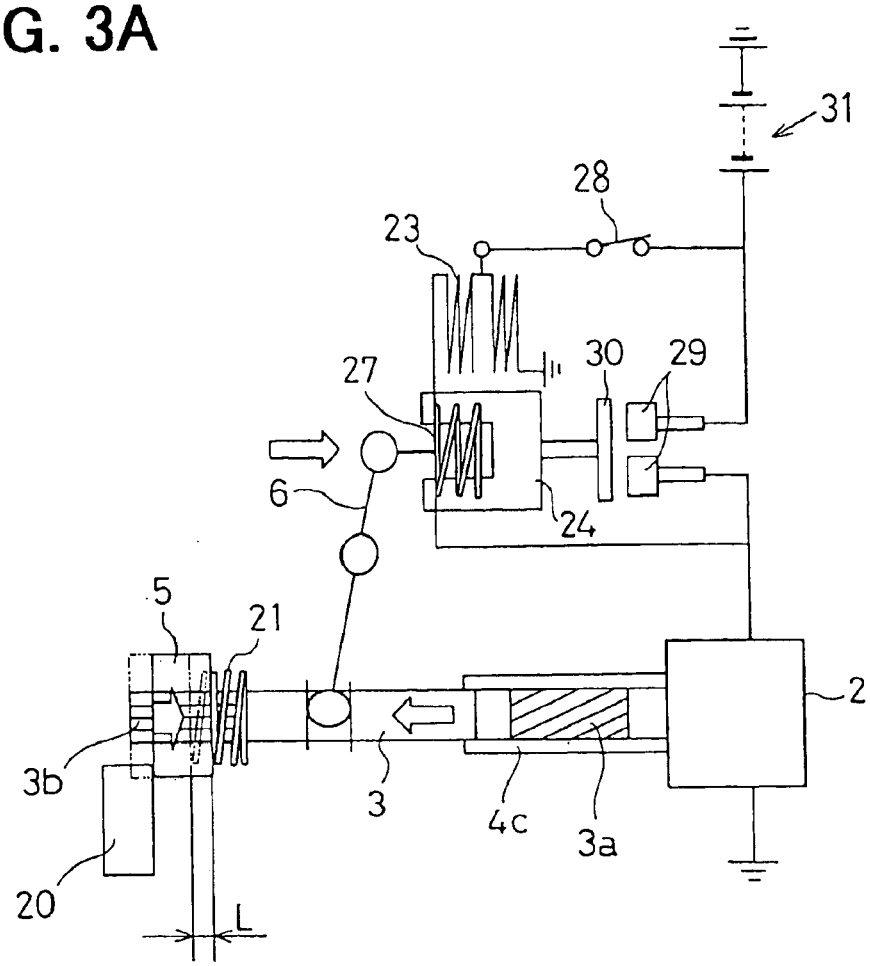
FIG. 3A is a schematic diagram illustrating operation of the starter according to the preferred embodiment.
Figure 6:
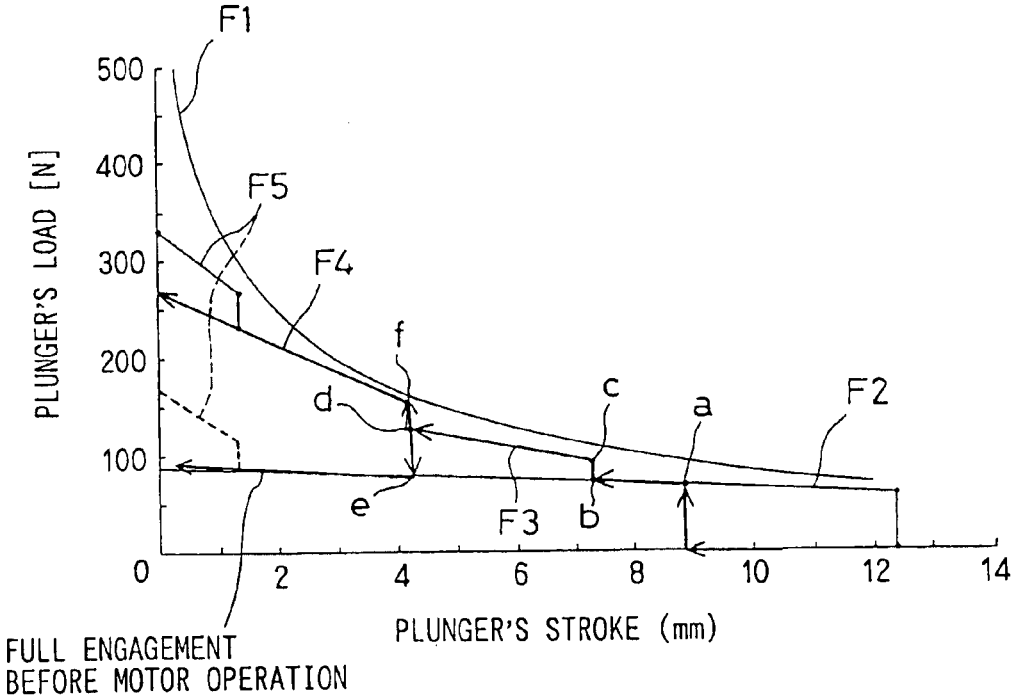
FIG. 6 is a graph showing a relationship between the stroke of the plunger of an electromagnetic switch and load applied to the plunger.

If the pinion 5 is stopped by a portion 5 of the ring gear 20 without engagement, the output shaft 3 is further moved forward by the electromagnetic switch via the drive spring 27 and the lever 6 against the spring force of the pinion spring 21, as shown in FIG. 3A, where the pinion 5 is ready for full engagement with the ring gear 20. At that time the plunger 24 moves from position b to position d as shown in FIG. 6. Incidentally, F1 represents a pulling force of the plunger 24, F2 represents a load of the return spring 25, F3 represents a load of the pinion spring 21, F4 represents a load of the drive spring 27, and F5 represents a load of the pressure spring.

Figure 3B:
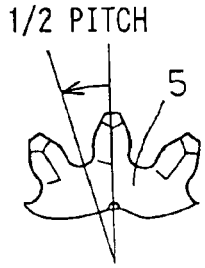
FIG. 3B is a fragmentary plan view of the pinion.

That means, from the viewpoint of the pinion spring 21, that the pinion 5 moves to the right by a stroke or a distance L along the output shaft 3, as shown in FIG. 3A, and the load of the plunger changes from point b to point c in FIG. 6. Accordingly, the pinion 5 is rotated by the helical spline connection an angle that corresponds to a half gear pitch or more of the pinion 5, as shown in FIG. 3B, until the pinion 5 fully engages the ring gear 20.

Figure 4:
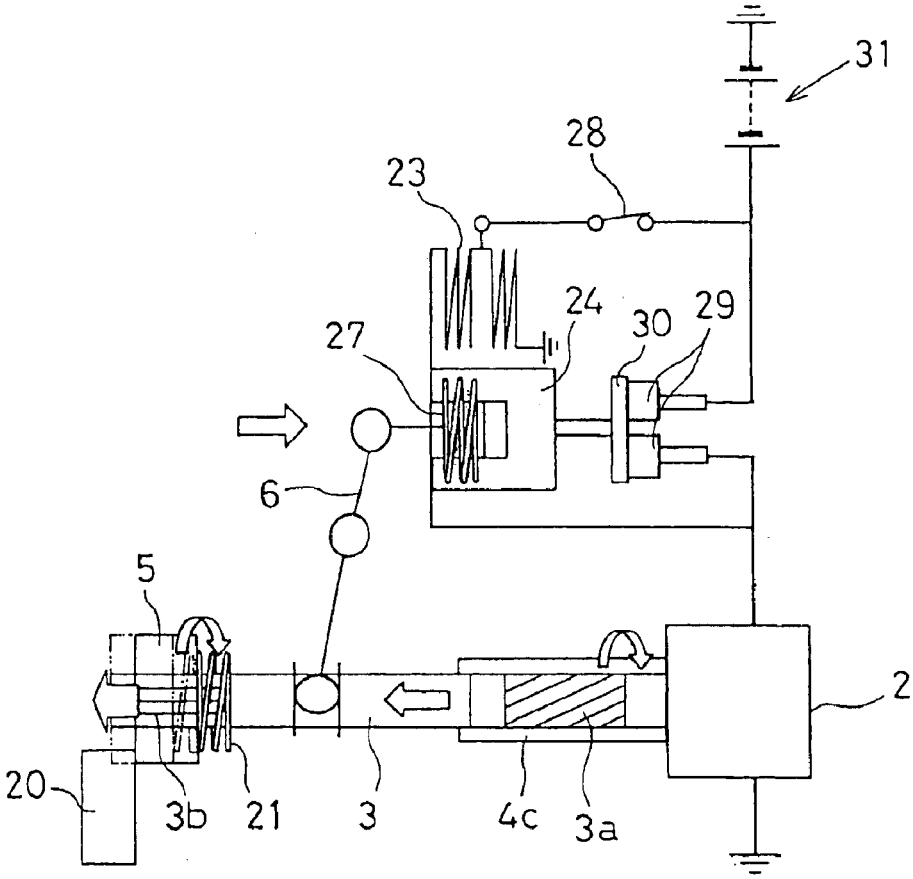
FIG. 4 is a schematic diagram illustrating operation of the starter according to the preferred embodiment.

If the pinion 5 is obstructed its rotation due to an interference of the gear edges of both the pinion 5 and the ring gear 20, the plunger moves further to the left to close the main switch 29, 30 to operate the motor 2. As a result, the motor 2 forcibly rotates the pinion 5 via the speed reduction mechanism, the one-way clutch and the output shaft 3, as shown in FIG. 4. Then, the plunger 24 moves from position c to position f, so that the pinion is pushed by the spring force F3 of the pinion spring 21 and the spring force F4 of the drive spring 27 to fully engage the ring gear 20.

According to test results, the pinion 5 can engage the ring gear 20 before the main switch 29, 30 is turned on at about 98% of probability. As a result, the pinion 5 and the ring gear 20 are prevented from wearing out.

As a modification of the above embodiment, it is possible to interchange the helical spline connection and the straight spline connection between the clutch-inner-and-output-shaft connection and the pinion-and-output-shaft connection. It is also possible to provide the helical spline connection for both the clutch-inner-and-output-shaft connection and the pinion-and-output-shaft connection.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. An engine starter comprising:

an electric motor;

a main switch, connected between said electric motor and a power source, for supplying electric power to said electric motor;

an output shaft;

a first spline connection member disposed between the electric motor and the output shaft;

a pinion disposed at an end of said output shaft to be engaged with or disengaged from a ring gear of an engine, said pinion having a prescribed pitch between adjacent teeth;

a second spline connection member disposed between said output shaft and said pinion;

a pinion spring disposed between said output shaft and said pinion to apply its spring force to said pinion toward the ring gear;

a lever connected to said output shaft;

an electromagnetic switch connected to said lever to drive said output shaft toward the ring gear when it is excited and to turn on said main switch when said lever moves to a prescribed position;

a drive spring disposed between said output shaft and said electromagnetic switch to apply its spring force to said pinion when said electromagnetic switch drives said output shaft toward the ring gear; wherein:

at least one of said first and second spline connection members comprises a spline connection member that rotates said pinion relative to said output shaft a prescribed angle that is equal to or more than a half of said prescribed pitch when said helical connection member is driven by said lever toward the ring gear; and said pinion spring has a spring constant that is smaller than a spring constant of said drive spring so that said pinion spring can be compressed to provide a stroke that allows said pinion to rotate the prescribed angle about said output shaft before said main switch is closed.

2. The engine starter as claimed in claim 1, wherein:

said first spline connection member comprises a helical spline connection member; and said second spline connection member comprises a straight spline connection member.

3. The engine starter as claimed in claim 1, wherein:

said first spline connection member comprises a straight spline connection member; and said second spline connection member comprises a helical spline connection member.

4. The engine starter as claimed in claim 1, wherein said first and second spline connection members respectively comprise helical spline connection members.

5. The engine starter as claimed in claim 1, wherein said first spline connection member comprises a spline tube which supports said output shaft.

6. The engine starter as claimed in claim 1, wherein said output shaft has a hollow to hold lubricating oil.

7. The engine starter as claimed in claim 1, further comprising a member for restricting said pinion to excessively retracting.

8. The engine starter as claimed in claim 5, further comprising a one-way clutch having a clutch outer member and a clutch inner member and a speed reduction mechanism connected between said one-way clutch and said electric motor, wherein said spline tube is formed in said clutch inner member.

9. The engine starter as claimed in claim 8, wherein:

said speed reduction mechanism comprises a planetary gear mechanism that includes a sun gear, an internal gear, a plurality of planetary gears and a carrier; and said carrier is integrated with clutch outer member.

10. The engine starter as claimed in claim 8, wherein said speed reduction mechanism and said one-way clutch are integrated into a unit having opposite ends jointly supported by a pair of bearings.

11. An engine starter comprising:

an electric motor;

a main switch for supplying electric power to said electric motor;

an output shaft;

a spline connection member disposed between the electric motor and the output shaft;

a pinion disposed to slide along said output shaft to be engaged with or disengaged from a ring gear of an engine, said pinion having a prescribed pitch between adjacent teeth;

a pinion spring which applies its spring force to said pinion toward the ring gear, first means for driving said output shaft toward the ring gear to engage a ring gear, said first means including a drive spring which applies its spring force to said pinion toward the ring gear;

second means for turning on said main switch when said first means can not drive said output shaft to engage the ring gear;

; wherein:

said spline connection member rotates said pinion relative to said output shaft a prescribed angle that is equal to or more than a half of said prescribed pitch when said helical connection member is driven by said lever toward the ring gear; and said pinion spring has a spring constant that is smaller than a spring constant of said drive spring so that said pinion spring can be compressed to provide a stroke that allows said pinion to rotate the prescribed angle about said output shaft before said main switch is closed.

* * * * *